US005979061A

United States Patent [19]

Demlakian-Apkarian

[11] Patent Number: 5,979,061

[45] Date of Patent: Nov. 9, 1999

[54] HAND-ACTUATED SCISSORS

[76] Inventor: Rita Demlakian-Apkarian, 96 Schermerhorn St. PH I, Brooklyn, N.Y. 11201

[21] Appl. No.: 08/950,090

[22] Filed: Oct. 14, 1997

[51] Int. Cl.[6] ..... A26B 13/18

[52] U.S. Cl. ..... 30/261; 30/232; 30/271; 30/298; 30/341; D8/57

[58] Field of Search ..... 30/261, 262, 231, 30/232, 253, 259, 271, 296.1, 298, 341; D8/57

[56] References Cited

U.S. PATENT DOCUMENTS

| | | | |
|---|---|---|---|
| 31,032 | 1/1861 | Reist | 30/262 |
| D. 322,546 | 12/1991 | Chan | D8/57 |
| 770,347 | 9/1904 | Brown | 30/341 |
| 1,130,085 | 3/1915 | Hill | 30/232 |
| 1,205,999 | 11/1916 | Kirmsee | 30/271 |
| 1,566,649 | 12/1925 | Carlson | 30/216 |
| 1,915,450 | 6/1933 | Schnefel | 30/262 |
| 3,921,640 | 11/1975 | Freeborn | 30/261 |
| 4,663,848 | 5/1987 | Sell | 30/261 |
| 4,960,419 | 10/1990 | Rosenberg | 30/296.1 |
| 5,297,343 | 3/1994 | Melter et al. | 30/262 |

FOREIGN PATENT DOCUMENTS

| | | | |
|---|---|---|---|
| 13866 | 6/1911 | United Kingdom | 30/271 |

*Primary Examiner*—Hwei-Slu Payer
*Attorney, Agent, or Firm*—Michael Ebert

[57] ABSTRACT

A hand-actuated scissors useable by an individual whose hands and fingers are weak or impaired and therefore experience difficulty in operating a conventional scissors. The scissors include a pair of blades whose cutting edges face each other, the blades being joined by a swivel pin whereby in an open state of the scissors the blades are angled with respect to each other. When the scissors are put into a closed state, the blades are then brought together to effect a cutting action. The handle sections of the blades which extend beyond the swivel pin are so shaped that in the open state the ends of these sections are widely spaced apart. Bridging the ends of the handle sections is a yoke defined by a saddle-shaped plate of resilient material forming a spring-loaded grip which normally maintain the scissors in an open state. When the grip is nested in the palm of a user's hand and grasped, the user by squeezing the grip with his or her hand can then bring the ends of the handle sections closer together, causing the scissors to assume a closed state to effect a cutting action. When pressure on the grip is released, the scissors automatically return to the open state preparatory to the next cutting action.

15 Claims, 4 Drawing Sheets

HAND-ACTUATED SCISSORS

BACKGROUND OF THE INVENTION

1. Field of Invention

This invention relates generally to cutting scissors, and more particularly to a scissors having a spring-action grip which when grasped by the hand of a user and squeezed then causes the normally-open blades of the scissors to close to effect a cutting action.

1. Status of Prior Art

A scissors is a cutting implement composed of two blades joined by a swivel pin that allows the cutting edges of the blades which face each other to open and close to effect a cutting action. Thus in cutting a sheet of cloth or paper, the user of the scissors closes the blades to cut an area of the sheet, and then opens the blades so that he or she can advance the scissors to a succeeding area of the sheet to be cut. It is essential therefore that the scissors include means to open and close the cooperating blades. Hereinafter the user will be referred to as "he" but it is to be understood that the user can also be a "she".

In a conventional scissors, each blade is provided with a handle section that extends beyond the swivel pin and terminates in a loop. The arrangement is such that when the scissors are in a closed state, the loop of one handle section is directly above the loop of the other handle section, the upper loop being smaller than the lower loop. To operate a conventional scissors, the user inserts the thumb of his hand into the upper handle loop and inserts two adjacent fingers into the larger lower handle loop, the index finger being curled about the lower loop handle section. Hence a conventional scissors is gripped only by the fingers of the user's hand, the fingers being manipulated to open and close the scissors.

The relationship between the fingers of a user's hand and the loop handles of a conventional scissors usually satisfies ergonomics or human engineering criteria, making it possible for a typical user to efficiently operate the scissors. But these conditions prevail only when the user's hand has strong fingers devoid of any impairment or disability.

However there are many individuals who suffer from arthritis, Parkinson's disease and various neurological finger-disabling disorders which make it difficult or painful to manipulate the fingers of a hand to operate a standard scissors having loop-type handles. And even if an individual is not suffering from a disorder which impairs his ability to manipulate the fingers of his hand, because of advanced age or other debilitating factors, the individual may be in a weakened condition and therefore finds it difficult to finger-operate a conventional scissors.

An individual must have sufficient strength in his fingers not only to close the blades of a conventional scissors to effect a cutting action, but also to open the blades. When the scissors is in a closed state, the blades are then in frictional engagement with each other, and it takes some measure of finger effort to overcome this friction to open the blades.

While the amount of effort required to operate a conventional scissors presents no problem to a user who is in his or her prime, it may present a problem to an older person, in a weakened condition especially since the position of the loop handles relative to that of the swivel pin which is the pivot point of the blades in a conventional scissors is such as to afford a low degree of leverage and mechanical advantage.

SUMMARY OF INVENTION

In view of the foregoing, the main object of this invention is to provide a hand-actuated scissors having a spring-loaded grip which when grasped by a hand of the user and squeezed, then causes the scissors to assume a closed state to effect a cutting action, the scissors automatically resuming an open state when pressure on the grip is relaxed.

A significant feature of a scissors in accordance with the invention is that it exploits the fact that a weakened or disabled individual who finds it difficult or painful to bend and unbend his fingers in order to manipulate loop handles of a conventional scissors, nevertheless retains the capacity to clench his fist to grasp and squeeze a ball or any other device that can be nested in the palm of the hand and gripped by the fingers. This clenching action which involves the entire hand rather than just the fingers, when exerted on the grip of a scissors in accordance with the invention, acts to distribute the cutting load throughout the hand rather than imposing it only on the fingers, as in a conventional scissors.

More particularly, an object of this invention is to provide a scissors of the above type in which a springloaded grip of resilient material bridges the free ends of the handle sections of the blades to enhance the mechanical advantage or leverage of the handles, thereby making it easier to operate the scissors.

Also an object of the invention is to provide an ambidextrous scissors having a grip attachable to either the left or right side of the handle sections whereby the scissors is useable by a right or left-handed user.

Still another object of the invention is to provide a scissors of the above type whose components are easily assembled whereby the scissors may be mass-produced at low cost.

Briefly stated, these object are attained by a hand-actuated scissors useable by an individual whose hands and fingers are weak or impaired and therefore experience difficulty in operating a conventional scissors. The scissors include a pair of blades whose cutting edges face each other, the blades being joined by a swivel pin whereby in the open state of the scissors the blades are angled with respect to each other, and when the scissors are put into a closed state, the blades are then brought together to effect a cutting action.

The handle sections of the blades which extend beyond the swivel pin are so shaped that in the open state the ends of these sections are widely spaced apart. Bridging the ends of the handle sections is a yoke defined by a saddle-shaped plate of resilient material forming a spring-loaded hand grip which normally maintain the scissors in an open state. When the grip is nested in the palm of a user's hand and grasped, the user by squeezing the grip with his hand can then bring the ends of the handle sections closer together, causing the scissors to assume a closed state to effect a cutting action. When pressure on the grip is released, the scissors automatically return to the open state preparatory to the next cutting action.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Referring now to FIGS. 1 to 5, it will be seen that a hand-actuated scissors in accordance with the invention includes two cooperating blades 10 and 11 made of stainless steel or other suitable blade material capable of cutting the sheet material for which the scissors is intended. Thus if the scissors is intended only to cut paper or other light sheet material, the blades may be made of aluminum or plastic rather than steel. The cutting edges 10E and 11E of the blades face each other in a cutting plane.

Figure 7:
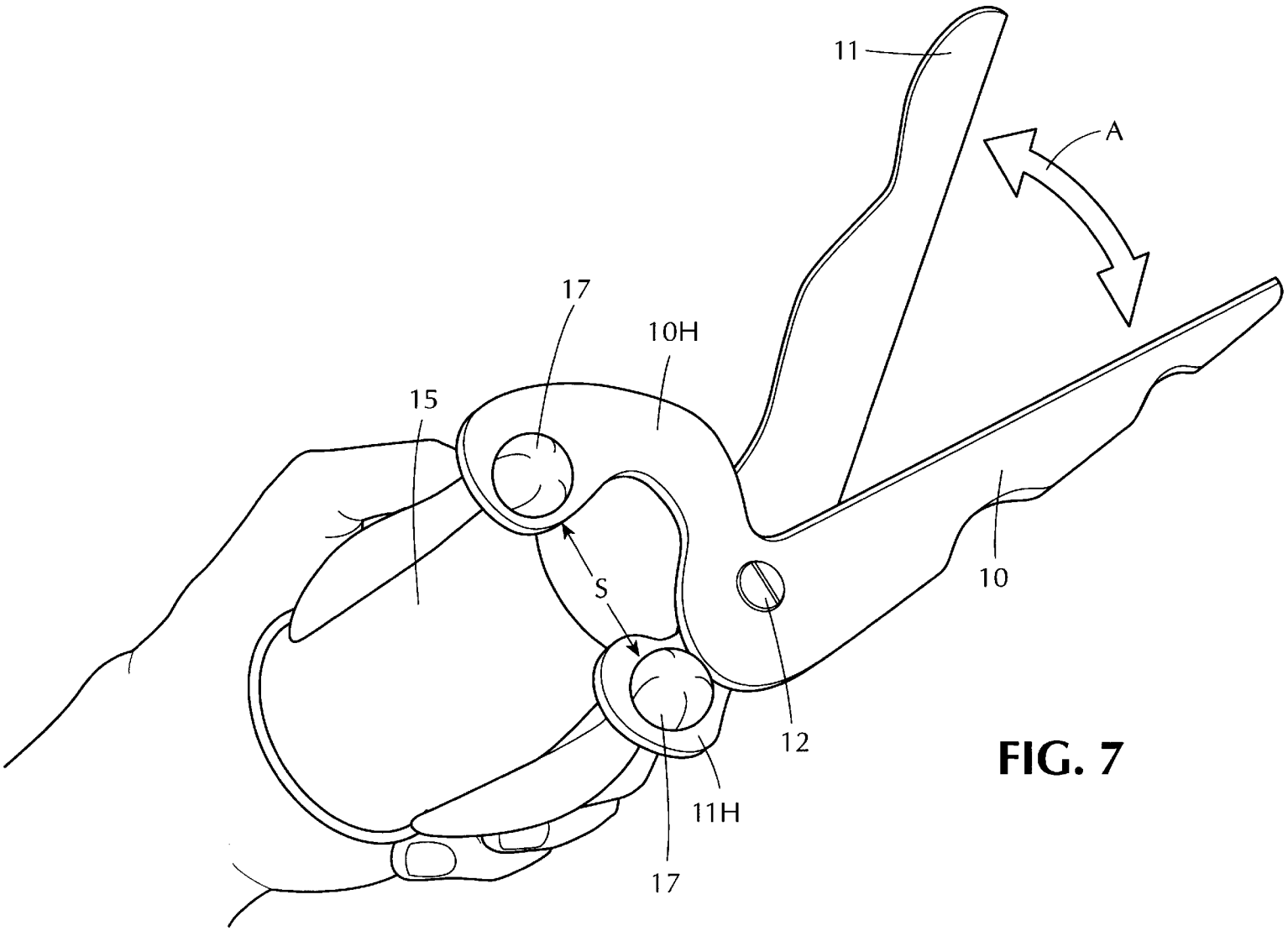
FIG. 7 illustrates the relationship between the angle of the blades and the space between the ends of the handle section of the blades.

The blades are pivoted together by a swivel pin 12 to provide a scissor action when the blades are manipulated. The handle section 10H of blade 10 which extends beyond the swivel pin is C-shaped, whereas the handle section 11H of blade 11 which extends beyond the swivel pin is nearly straight. Hence as best seen in FIG. 7, in an open state when the blades of the scissors are angled with respect to each other, the ends of handle section 10H and 11H are spaced widely apart.

When the scissors is put by the user into a closed state to bring the blades together to effect a cutting action, the blades then overlap. To prevent blades 10 and 11 from going beyond this closed state, blade 10 is provided with a stop pin 13, that is engaged by a notch 14 in the edge of blade 11, thereby arresting further movement.

Bridging the free ends of handle sections 10H and 11H of the blades is a yoke formed by a saddle-shaped plate 15 of resilient synthetic plastic material, such as polypropylene or polyethylene. Alternately, the plate may be fabricated of spring steel. The saddle-shaped plate functions as a hand grip having spring characteristics, for when the spring-loaded grip is squeezed, the opposing flanks of the saddle are brought closer together and when the pressure is released, the flanks recover their original parallel position.

The parallel flanks of saddle-shaped plate 15 forming the grip of the scissors are socketed in slots in a pair of crescent-shaped holders 16 having a stem projecting from the midpoint of the holder. The midpoint stems are joined to the free ends of handle sections 10H and 11H by removable plugs 17. Plugs 17 which have hollow shanks are inserted through bores in the ends of the handle sections to engage the stems of the holders. In practice, instead of plugs use may be made of screws, in which case holes in the stems of the holders are threaded to receive these screws. Also in practice, the synthetic plastic grip and the holders coupled to the flanks of the saddle may be integrated and molded as a single piece.

Because of the spring characteristics of grip 15 yoking the ends of the handle sections of the blades and extending laterally therefrom, the spring-loaded grip acts to normally maintain the scissors in the open state in which the ends are widely spaced apart.

Figure 1:
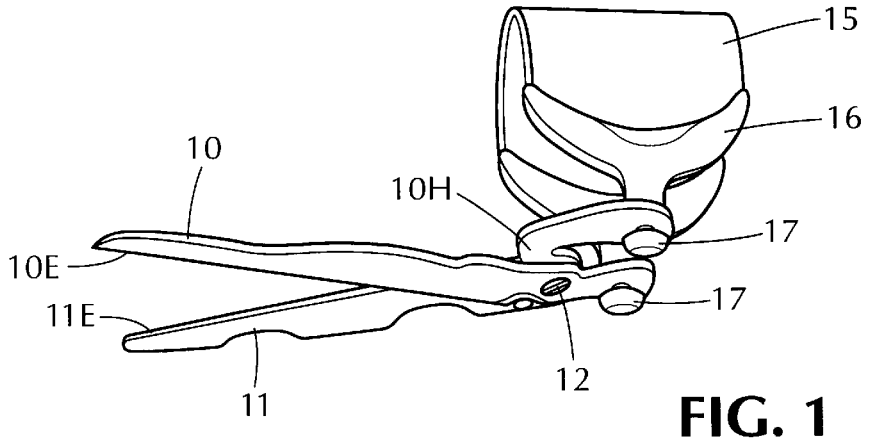
FIG. 1 is a perspective view of a scissors in accordance with the invention.
Figure 2:
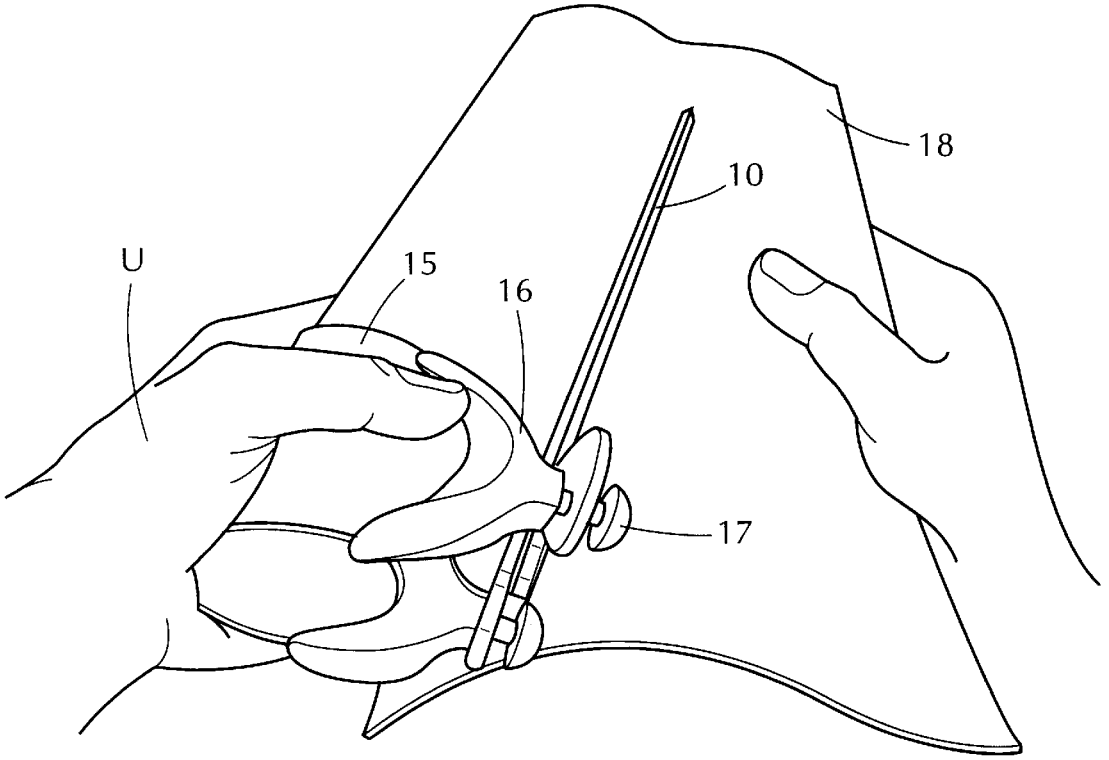
FIG. 2 illustrates the scissors being operated to cut fabric sheet.
Figure 4:
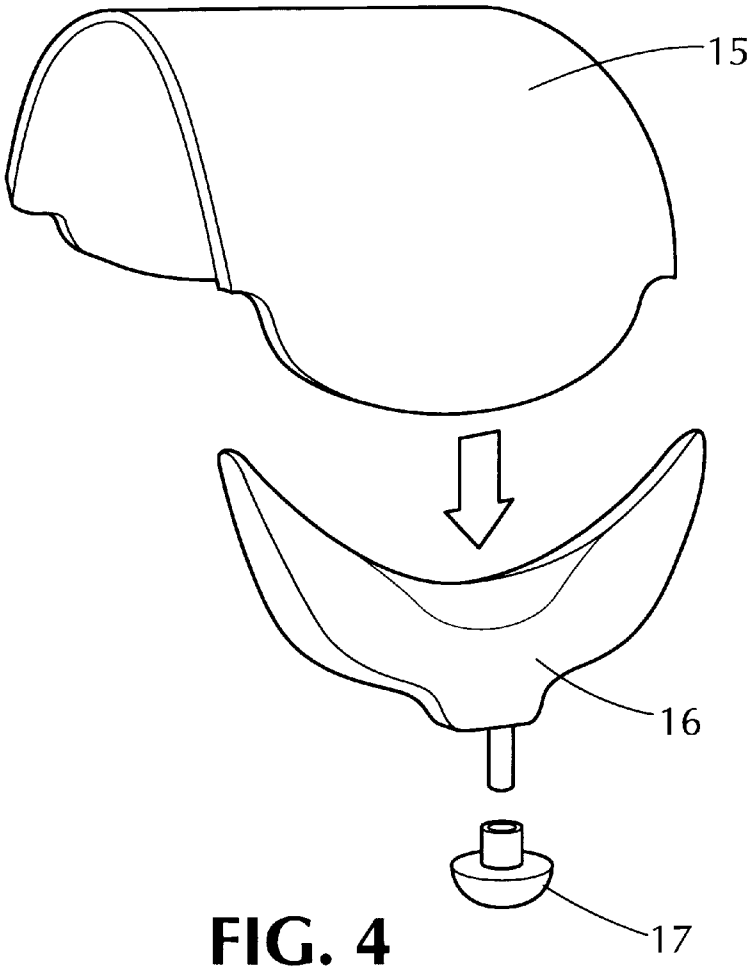
FIG. 4 shows the components which when assembled create the grip of the scissors.
Figure 3:
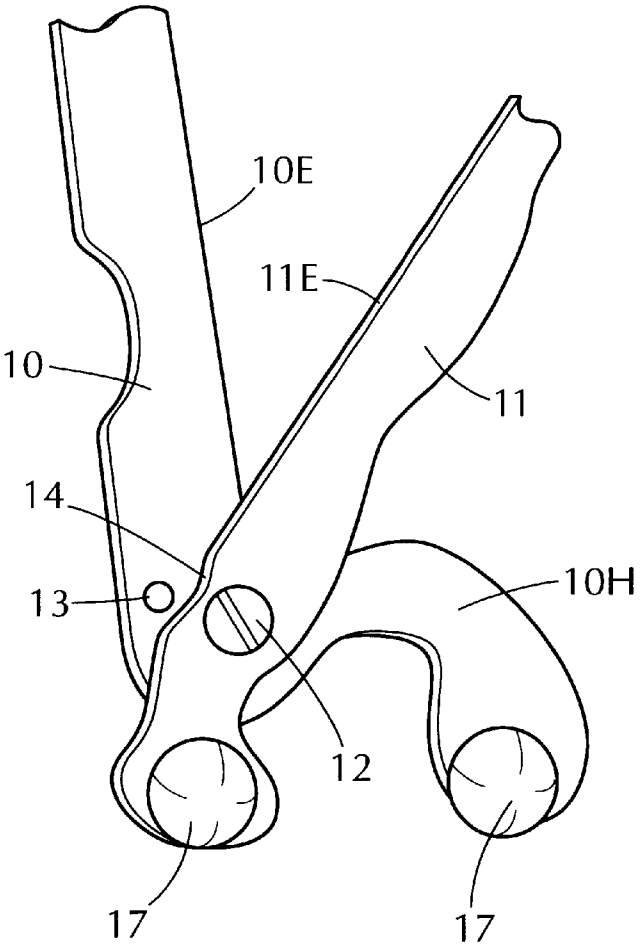
FIG. 3 shows the handle sections of the blades of the scissors.
Figure 5:
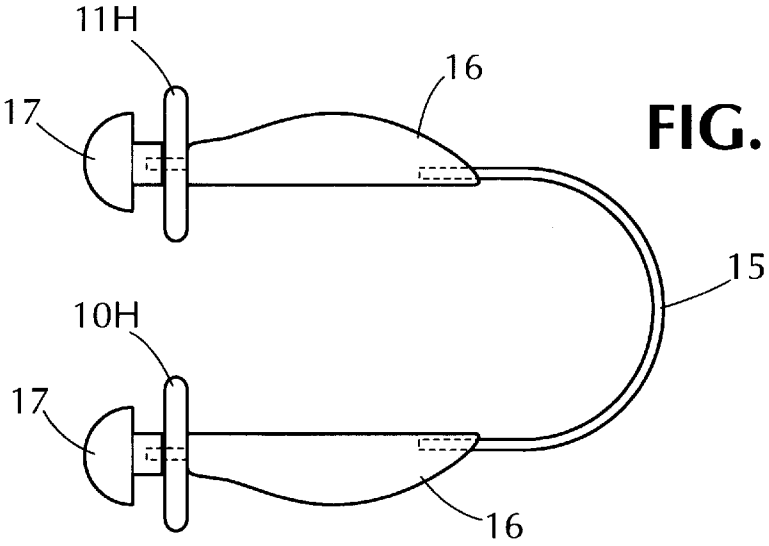
FIG. 5 shows the components of the grip coupled to the ends of the handle sections.

In operation, the saddle-shaped grip is nested in the palm of the hand of a user U, as shown in FIG. 2, and grasped by the fingers of the hand so that the grip is firmly socketed in the hand. When the hand squeezes the grip, this action brings the ends of the handle sections closer together. As a consequence, blades 10 and 11 move closer together to assume a closed state effecting a cutting action.

This cutting action is illustrated in FIG. 2 in which the scissors are shown cutting a sheet of cloth 18 by repeatedly squeezing the grip of the scissors with the hand, each squeeze being followed by a relaxation of pressure. With each squeeze, an area of the cloth is cut, this being followed by a relaxation of pressure causing the blades to then open to permit the scissors to advance to the succeeding area of fabric to be cut.

In a conventional scissors having loop type handles, it is the fingers of the hand going into the loops that operate the scissors. And these fingers must be strenuously manipulated to open and close the blades, particularly when the sheet being cut is resistant to a cutting action.

In a hand-actuated scissors in accordance with the invention, it is the entire hand socketing the grip of the scissors that comes into play in effecting a cutting action, for it is the collective action of the fingers and of the palm which together exert a squeezing force on the spring-loaded grip. Hence while individual fingers of the hand of the operator may be weak or impaired, collectively the fingers retain their capacity to operate in conjunction with the palm of the hand to squeeze the grip socketed on the hand. For example, an individual whose trigger finger is so weak that he cannot pull the trigger of a pistol is yet capable of firmly grasping the grip of the pistol with his hand.

Thus it is far easier for a user who has difficulty in operating a conventional scissors because of impaired fingers to hand-actuate a scissors in accordance with the invention. Moreover, in this scissors, the saddle-shaped grip coupled to the handle sections of the blades acts effectively as an extension of these sections beyond the pivot point to provide greater leverage and purchase than is obtainable with conventional scissors. Because of this enhanced mechanical advantage, the operator of the scissors has greater control of a cutting operation than with a conventional scissors.

Because the grip is coupled to the ends of the handle sections of the scissors by removable plugs, the scissors are ambidextrous and can be accommodated to the left or right hand of the operator, for the grip can be coupled to join the right or left side of the scissors.

It is essential that when the grip of the scissors is socketed in the hand of an operator, that it not slip out of the operator's hand; particularly when the hand is moist as a result of effort being exerted in the course of cutting. Hence the outer surface of the grip should not be slippery, but should be coarse so as to frictionally engage the palm of the hand and the fingers grasping the grip.

Figure 6:
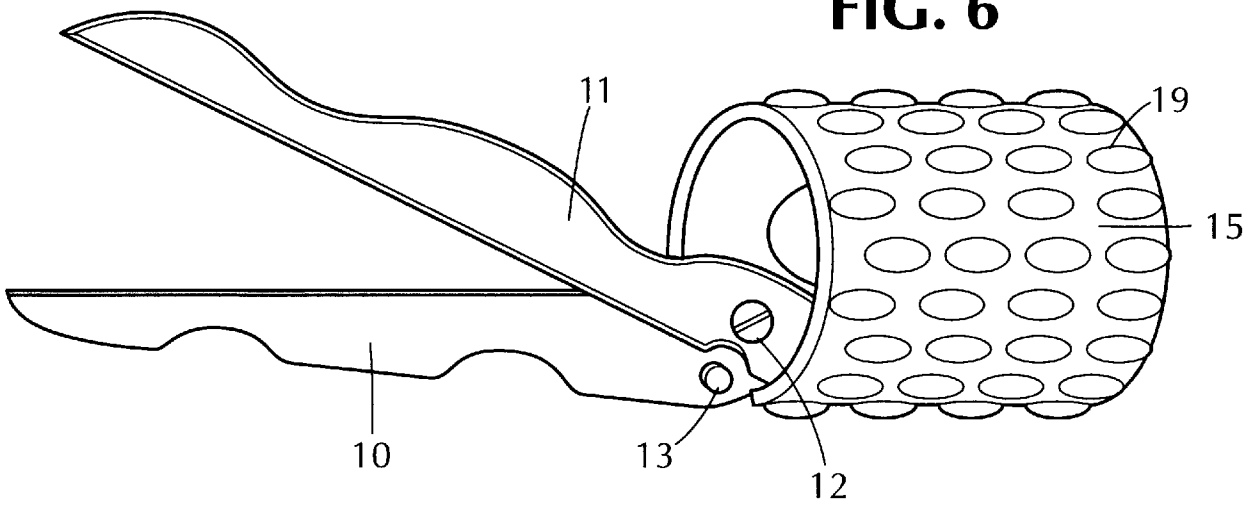
FIG. 6 illustrates a modified form of grip.

A preferred form of grip is shown in FIG. 6 where it will be seen that the saddle-shaped grip 15 is coated with a soft gel 19 that is molded to form a pebbled or rough surface.

FIG. 7 illustrates the relationship between the angle A of blades 10 and 11 of the scissors and the space S between plugs 17 at the ends of the handle sections 10H and 11H. When no pressure is applied by the hand to the saddle-shaped grip 15 bridging these ends, space S between the ends and the resultant angle A are at a maximum value. This represents the fully open state of the scissors. When the grip is squeezed by the hand, this action brings the ends of the handle sections closer together and reduces angle A between the blades to a minimum value to effect a cutting action.

Though a scissors in accordance with the invention is expressly designed to render it useable by an operator who because of some disability finds it difficult to operate a conventional scissors, it has many advantages over conventional scissors and is therefore useable by an operator who is capable of operating a conventional scissors.

The scissors can be modified to accommodate the requirement of users having different hand sizes and strengths by making available to purchasers of the scissors separate grips therefor which differ in regard to size, strength and spring-characteristics. Thus one can provide a small size child version of the grip that is relatively easy to squeeze and larger versions for adults having big and relatively strong hands. Also grips may be made with different textures or patterns and coatings, such as rubber rather than a gel, thereby giving a prospective purchaser the freedom to choose a grip best suited to his needs as well as to his taste.

The scissors shown in the drawings, when not in use, is in an open state by reason of the spring-loaded grip which normally maintains the blades angled with respect to each other. It is desirable when the scissors is packaged, stored and shipped that it then be in a closed state, as is the case with conventional scissors. To this end one may provide the scissors with a latching mechanism which when latched maintains the scissors in a closed state. A simple detachable latch for this purpose could be a short bridging bar attachable to the ends of handle sections 10H and 11H.

While there has been shown and described preferred embodiments of a hand-actuated scissors in accordance with the invention, it will be appreciated that many changes and modifications may be made therein without, however, departing from the essential spirit thereof.

I claim:

1. hand-actuated scissors comprising:

A. a pair of blades joined together by a swivel pin to cause cutting edges of the blades to face each other in a cutting plane, each blade having a handle section extending beyond the pin, the handle sections of the blades being so shaped that when the scissors are fully open and the blades are angled with respect to each other; respective ends of the handle sections are then widely spaced apart; and B. a spring-loaded saddle-shaped grip formed of resilient material having opposing flanks which are fixedly coupled to the ends of the handle sections and project laterally therefrom in a direction perpendicular to said cutting plane to bridge said ends, said saddle-shaped grip being dimensioned to occupy and fit into a palm of a user's hand and to have the flanks thereof grasped by its fingers whereby when the grip is subjected to squeezing pressure by the entire hand, the grip then shortens the space between the ends of the handle sections to cause the blades to assume a closed state to effect a cutting action, the blades returning automatically to an open state when pressure on the grip is released.

2. A scissors as set forth in claim 1, in which one of handle sections has a C-shape and the other has a substantially straight shape.

3. A scissors as set forth in claim 1, in which the blades are formed of stainless steel.

4. A scissors as set forth in claim 1, in which the blades are formed of aluminum.

5. A scissors as set forth in claim 1, in which the grip is formed of a U-curved plate of synthetic plastic material to define a saddle having opposing flanks.

6. A scissors as set forth in claim 5, in which the plate has a coarse non-slip surface.

7. A scissors as set forth in claim 6, in which the coarse surface is created by a gel coating the surface of the plate.

8. A scissor as set forth in claim 6, in which the coarse surface is formed of rubber.

9. A scissors as set forth in claim 1, in which the grip is formed of spring steel.

10. A scissors as set forth in claim 1, in which one blade is provided with a stop pin that engages a notch in the other blade to prevent the blades from going beyond the closed state.

11. A scissors as set forth in claim 1, in which the grip is adapted to be coupled to either side of the handle sections to project laterally therefrom whereby the scissors are ambidextrous and can be accommodated to a left or right hand of the user.

12. A scissors as set forth in claim 1, in which the opposing flanks of the grip are coupled to the ends of the handle sections by a pair of holders attached to these ends, the flanks of the grip being socketed in the holders.

13. A scissors as set forth in claim 12, in which the holders are integrated with the flanks of the grip.

14. A scissors as set forth in claim 12, in which the holders are joined to the ends of the handle sections by removable plugs.

15. A scissors as set forth in claim 14, in which the holders are crescent-shaped and are respectively provided with stems in which the plugs are inserted.

* * * * *